United States Patent [19]

Hodges et al.

[11] Patent Number: 4,550,868

[45] Date of Patent: Nov. 5, 1985

[54] METHOD AND APPARATUS FOR TRANSFERRING HOSIERY BETWEEN HOSIERY MANUFACTURING MACHINES

[75] Inventors: Michael J. Hodges; Malcolm K. Scanes, both of High Wycombe, England

[73] Assignee: Detexomat Machinery Ltd., Buckinghamshire, England

[21] Appl. No.: 576,548

[22] Filed: Feb. 3, 1984

[30] Foreign Application Priority Data

Feb. 4, 1983 [GB] United Kingdom ..... 8303159

[51] Int. Cl.[4] ..... D05B 33/00; D06G 3/04

[52] U.S. Cl. ..... 223/43; 112/121.15; 223/75; 223/112

[58] Field of Search ..... 112/121.15, 262.2, 121.29; 223/60, 75, 76, 77, 112, 42, 43

[56] References Cited

U.S. PATENT DOCUMENTS

| | | | |
|---|---|---|---|
| 2,722,348 | 11/1955 | Ammon | 223/43 |
| 4,196,681 | 4/1980 | Chietti | 223/43 X |
| 4,364,320 | 12/1982 | Nakhi et al. | 112/262.2 |
| 4,434,918 | 3/1984 | Hodges | 223/75 |
| 4,440,329 | 4/1984 | Hodges | 223/43 |
| 4,444,140 | 4/1984 | Moyer | 112/121.29 X |

FOREIGN PATENT DOCUMENTS

| | | |
|---|---|---|
| 0033039 | 8/1981 | European Pat. Off. . |
| 2508506 | 12/1982 | France . |
| 2042322 | 9/1980 | United Kingdom . |
| 2081316 | 2/1982 | United Kingdom . |
| 2103257 | 2/1983 | United Kingdom . |

*Primary Examiner*—Louis K. Rimrodt

*Attorney, Agent, or Firm*—Dority & Manning

[57] ABSTRACT

Hosiery manufacturing equipment comprises a line closer (L) and a toe closer (T) which are linked by a hose transfer mechanism (M) consisting of two conveyors (30, 31) which overlap in a region between the closers (L, T). The conveyors have respective hose holders (39, 40) which coact in the overlap region so that hose carried by the first holder (39) are stripped therefrom and taken over by the second holder (40) which ultimately mounts the hose on the toe closer (T); the first holder is responsible for stripping the hose from the line closer (L) and for rotating the hose through a predetermined angle which is related to a difference in angular attitude between respective hose supports (10, 16) of the two closers (L, T).

26 Claims, 15 Drawing Figures

Figure 1:
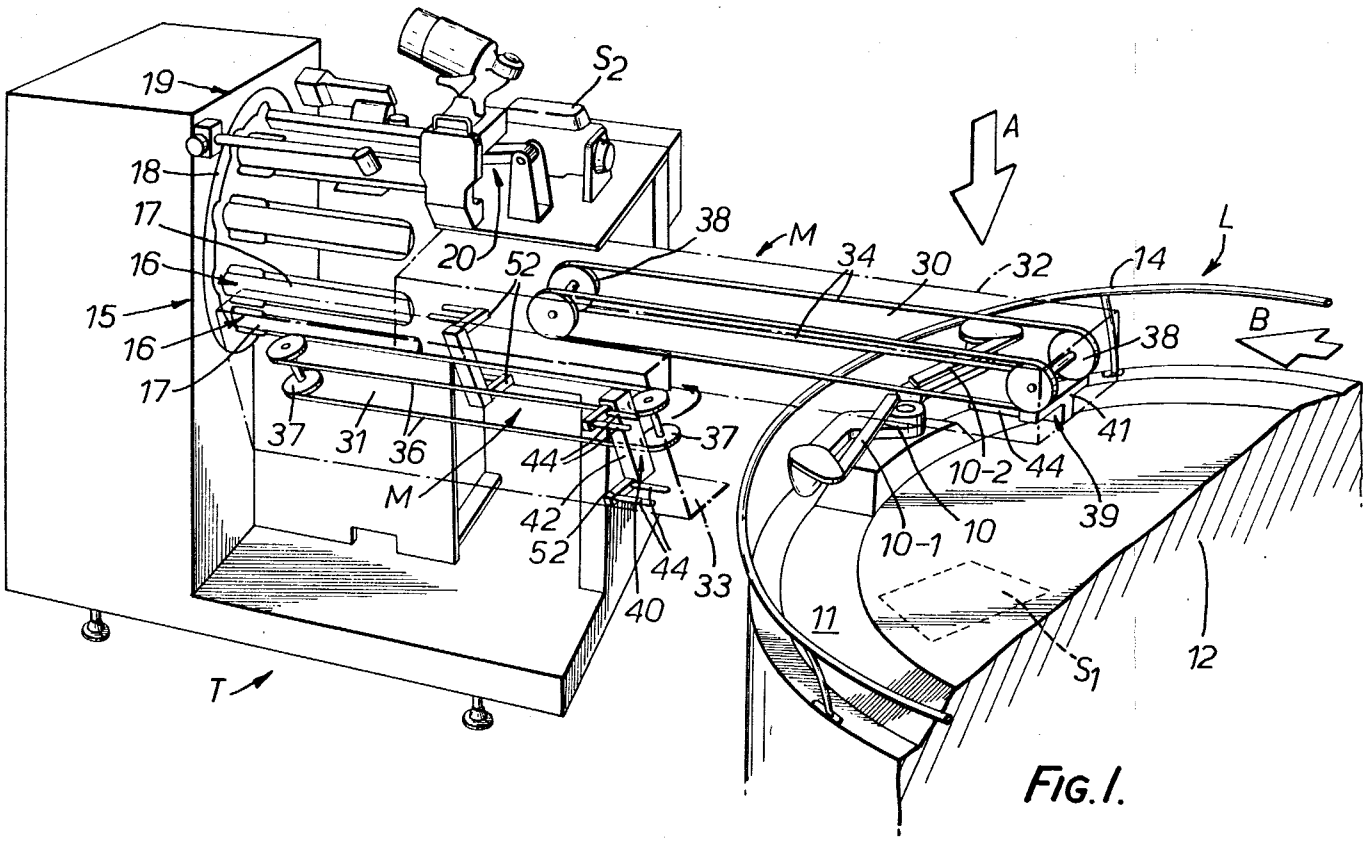

METHOD AND APPARATUS FOR TRANSFERRING HOSIERY BETWEEN HOSIERY MANUFACTURING MACHINES

The present invention relates to method and apparatus for transferring hosiery between hosiery manufacturing machines.

The invention more particularly relates to the transfer of unfinished pantihose between a line closer and a toe closer. Pantihose manufacture can be rationalised considerably, with various advantages to be gained, if open-ended leg blanks are first joined together and then toe closed. The line closer functions to join the legs (to form the body portion of the pantihose).

A line closer which will be familiar to hosiery specialists is the Takatori Line Closer, e.g. Models LC-240, LC-280 and LC-320 made by Takatori Machinery Mfg. Co. Limited of Yamatotakada City, Japan. Toe closers capable of closing the associated legs of pantihose at effectively the same time (or in quick succession) are the Pantimatic and Speedomatic HS toe closers made by Detexomat Machinery Limited. PANTIMATIC, SPEEDOMATIC and DETEXOMAT are Registered Trade Marks or pending applications therefor.

Current usage of the aforementioned line closer machine favours loading it—manually—with toe-closed pairs of legs. Although automatic means exists for removing line-closed hose from this machine, the need to initially load manually remains. Initial loading of the aforementioned toe closers also involves a manual operation. The usual method of making pantihose therefore involves two manual loading steps and this limits manufacturing efficiency.

We have recognised that if pantihose are manufactured by line closing first and then toe closing, one manual loading operation might beneficially be omitted with the use of a suitable transfer apparatus working between the two closers.

Automatic transfer of hose from a leg support to an eversion tube arrangement alongside the leg support in a toe closer is known. Transfer means which (i) enter the welt end of a hose leg, (ii) strip it from the support, (iii) displace the welt laterally towards the eversion tube arrangement, (iv) deposit the welt on the latter and (v) then slip from the welt, are found in the Speedomatic H toe closer of Detexomat Machinery Limited. This transfer means is disclosed in GB-PS No. 1,408,912B.

Line closers and toe closers of the kinds specified above are far from ideally suited to automatic transfer of hose from one to another. This is inter alia because their respective hose supports at the discharge and loading stations are in different attitudes. One machine has its hose supporting means lying in a horizontal plane while the other machine has its hose supporting means inclined at a substantial angle to the horizontal, at these stations. We have, however, overcome this difficulty in a development (forming the basis of this invention) which in principle starts from the known Speedomatic H transfer means.

According to the present invention, there is provided hosiery manufacturing equipment including two spaced-apart hose supports, which extend in the general direction of each other, and a transfer mechanism which strips hose from one support, carries it to the other support and loads it thereon, the transfer mechanism including conveying means extending between the supports and a hose holding means fast with the conveying means for travelling repetitively between the supports, the holding means having a set of fingers directed forwardly towards the said other support when travelling in the direction thereof, said fingers being mounted to move into the welt end of a hose on the said one support, to carry the welt end to the said other support, and to place the welt end in an encircling relation on the latter support, the equipment further comprising means which effect a predetermined rotation of the hose so that when the hose is placed on the said other support, it is in a predetermined rotational attitude on the latter. The said supports may be mutually inclined when the hose rotation means effect a rotation of the hose which is related to the angular relationship between the supports.

Most conveniently, but not essentially, the hose rotation means is associated with the transfer mechanism and is operative to effect hose rotation in the course of the travel to the hose to the said other support. Such an arrangement is disclosed in detail hereinafter.

Preferably the set of fingers is the hose rotating means and is carried by a pivotal mounting to rotate as a unit about an axis parallel to the fingers, there being means to rotate the finger unit in the course of the movement of the hose holding means between the supports. The hose rotation means can further include a motor-driven roller which the holding means fingers contact in the course of the movement between the supports, the roller in use being controlled to turn the hose about the set of fingers through a predetermined rotational angle.

Whilst the conveying means could comprise a single conveyor, in a preferred embodiment, the conveying means comprise two elongated conveyors each having respective hose holding means with sets of forwardly-directed fingers, the conveyors being mounted so the downstream end of the first conveyor, which takes hose from the said one support, overlaps the adjacent upstream end of the second conveyor, the respective hose holding means being arranged to move into juxtaposition in the region where the conveyors overlap for the hose holding means of the second conveyor to strip the hose from the hose holding means of the first conveyor. In this embodiment the first conveyor is intermittently driven such that its holding means pauses in the overlap region for the moving holding means of the second conveyor to strip the hose from the stationary holding means.

The invention is particularly, but not exclusively, suitable for use as a means to convey hosiery articles between a line closer and a toe closer. The following description discloses the invention in detail in relation to this particular use.

The present invention will now be described in more detail by way of example only with reference to the accompanying drawings, in which:

FIG. 1 is a general assembly view illustrative of the present invention and showing a line closer and toe closer linked by a hose transfer mechanism.

Figures 1, 2:
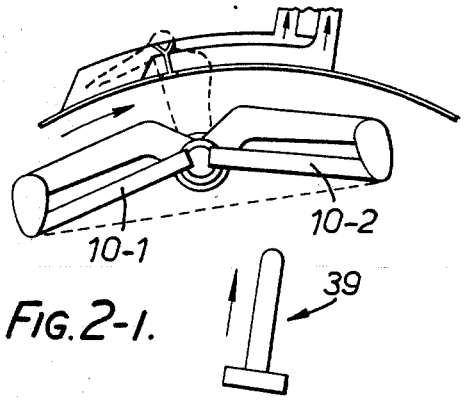
Figure 2:
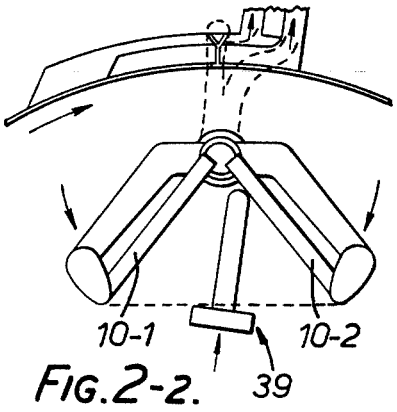
Figures 2, 3:
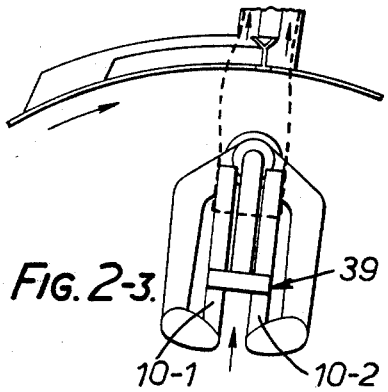
Figures 2, 3, 4:
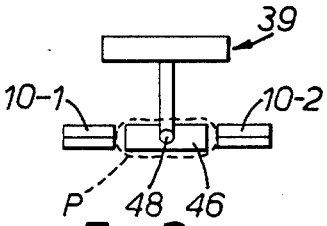
Figures 2, 3, 4, 5:
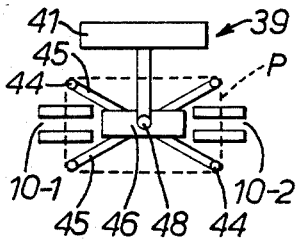
Figures 2, 3, 4, 5, 6:
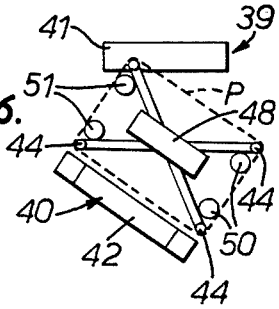
Figures 2, 3, 4, 5, 6, 7:
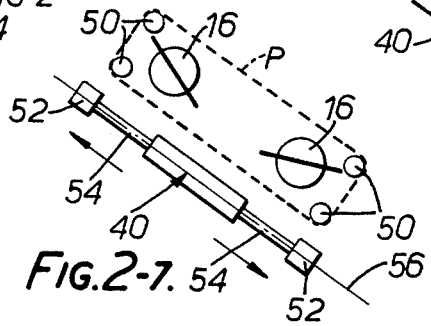
Figure 3A:
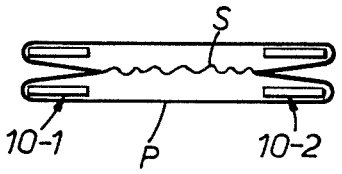
Figure 3B:
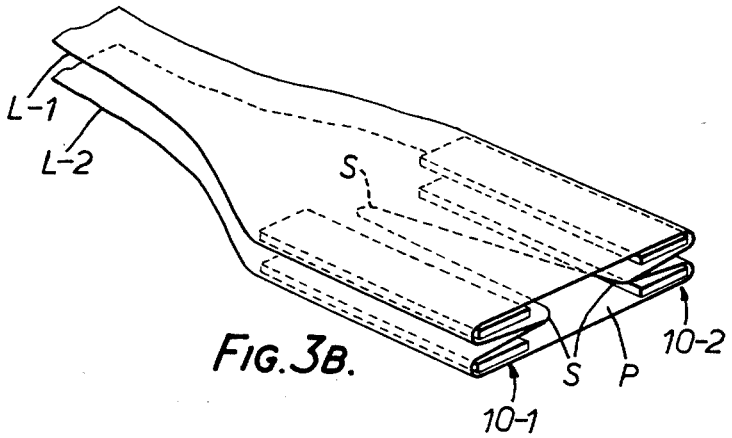
Figure 4A:
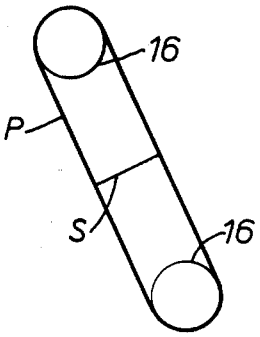
Figure 4B:
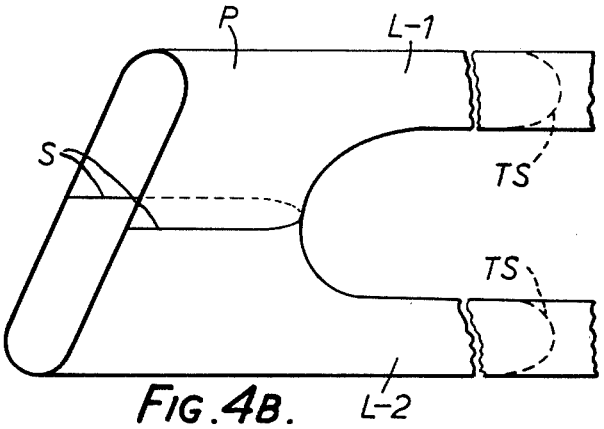
Figure 5:
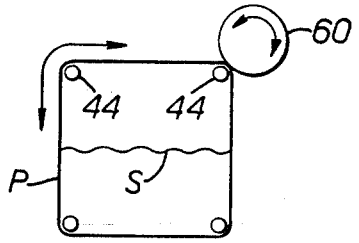
Figure 6:
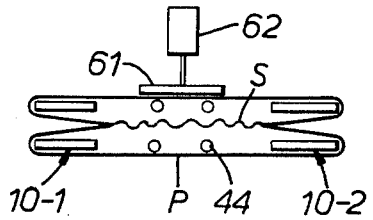
Figure 7:
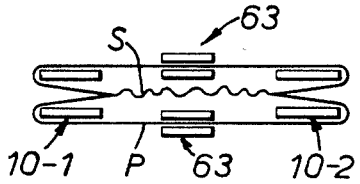

FIGS. 2(1) to (7) are illustrative views of parts of the equipment shown in FIG. 1 during selected phases of the transfer operation;

FIGS. 3A and 3B diagrammatically show the arrangement of a pantihose garment on a support of a line closer and ready for stripping therefrom;

FIGS. 4A and 4B similarly show the garment as arranged on adjacent supports of a toe closer; and FIGS. 5 to 7 illustrate modifications of the embodiment shown.

FIG. 1 of the drawings shows a hosiery manufacturing installation for converting open-ended knitted leg blanks into panithose. The installation comprises a line closer L, a toe closer T and a transfer mechanism M. As illustrated, the line closer L is of Takatori manufacture and the toe closer T is a Detexomat Speedomatic HS machine. A very detailed explanation of these machines and their operation will not be given here, and only as much explanation will be provided as necessary to allow of an appreciation of the present invention.

The line closer L has a plurality of two-armed hose supports 10 mounted at spaced intervals around an annular turntable 11 which rotates in a horizontal plane about a fixed centre table 12 on which a sewing machine is mounted at S1. In use, two hose leg blanks are drawn manually, welt-end first, onto the two arms 10-1 and 10-2 of the hose support 10 at a loading station of the machine. The parts of the blanks not held on the support 10 are draped over a circular rail 14. The welt ends of the hose legs are subsequently clamped and slit, and their slit edges held together by the support 10. So held, the edges are suitable moved past the sewing machine at S1 which joins the juxtaposed edges and thereby forms the body of the pantihose. Leaving the sewing machine, the support 10 proceeds to a discharge position. The single support shown in FIG. 1 is at this position but has yet to be activated for the actual discharge. As shown, the two arms 10-1 and 10-2 of the support 10 are horizontal in a spreadeagled condition. Upon activation for discharge, the arms are swung towards one another into a parallel, side-by-side condition. When parallel, the arms 10-1 and 10-2 extend radially of the vertical turning centre of the line closer L. Moreover, they are in a horizontal attitude. That is, a plane passing through both the arms is horizontal, parallel to the plane of the turntable 11.

U.S. Pat. No. 4,303,026 gives further details of a line closer similar to the Takatori line closer shown here.

The transfer mechanism M strips the partly-finished pantihose from the line closer L and conveys it to the toe closer T. The mechanism M takes hold of the pantihose body portion when the arms 10-1 and 10-2 of the line closer support 10 have been activated for discharge. The mechanism then carries the body portion towards the toe closer. In the course of transporting the pantihose, the mechanism adjusts the pantihose inter alia to suit the difference in orientation between the horizontal support 10 and the toe closer supports while the latter temporarily occupy a loading station 15. The mechanism M then places the pantihose body portion on the toe closer supports. The toe closer completes the loading operation.

Two adjacent toe closer supports 16 mount the legs and body of the pantihose throughout the toe closing sequence. Loading involves offerring the legs to suction tubes 17 forming an integral part of the two supports 16. The legs are drawn into the tubes 17 while the body is disposed by the mechanism M on the two leg supports 16. Inside the suction tubes 17, any twist there may be in the legs is removed and the legs are straightened. The body is in an encircling relationship to the supports 16. Once the pantihose has been placed in this fashion on the supports 16, the toe closer itself functions to draw the hose fully onto the supports 16. As this is done, the hose legs leave the suction tubes 17 and are each drawn onto a respective one of the two adjacent supports 16. This everts the pantihose legs. During subsequent operation of the toe closer T, the supports depart from the loading station 15 and proceed (by rotation of a turret 18 mounting the supports 16) to a seaming station 19. At this station toe ends of the legs are presented by a clamping mechanism 20 to sewing machine S2 which automatically stitches toe closing seams across the toe ends of the pantihose legs. When this has been accomplished, the pantihose is ready for discharge; this final phase of the toe closing operation is not relevant to an understanding of this invention and hence is not described herein.

As noted above, the line closer supports 10 have their arms 10-1 and 10-2 parallel and lying in a common horizontal plane when activated for discharge. The two toe closer supports 16 to be loaded at station 15 extend horizontally, but a common plane through them is inclined to the horizontal. The angle of inclination may be 54°. The transfer mechanism M caters for the angular disparity between the supports 16 and the arms 10-1, 10-2, so that the pantihose legs are offerred properly to the supports 16. Moreover, the transfer mechanism M arranges the pantihose such that its line-closed body seam is placed in a proper attitude upon the toe closer supports. If the pantihose is improperly loaded, toe closing seams formed therein may be inappropriately related to the body seam. FIGS. 3 and 4 should make clear the attitude of the pantihose at discharge from the line closer L and loading of the toe closer T.

FIG. 3A shows an end view of the arms 10-1, 10-2 in their relative positions ready for discharge of the pantihose P thereon. The body or line seam S is located generally in the common horizontal plane in which the arms lie. FIG. 3B in perspective shows the disposition of the pantihose P and seam S relative to the arms. The pantihose legs L-1, L-2 are positioned approximately one above the other. FIG. 3A represents the arrangement of pantihose and arms 10-1, 10-2 when viewed in the general direction of the arrow B, looking towards the toe closer T.

FIG. 4A shows an end view of the supports 16 of the toe closer T with the pantihose P mounted fully thereon ready for the toe closer to commence its toe closing operation. FIG. 4A is seen from substantially the same viewpoint as FIG. 3A and the angular disparity between the pantihose P as mounted on the line closer L and as mounted on the toe closer T will be readily apparent. Compare the attitudes of the seams S as illustrated. FIG. 4B diagrammatically shows the fully-mounted hose P at the toe closer loading position 15, looking towards the arrow B. FIG. 4B also shows, at TS, the toe closing seams to be generated across the ends of the legs L-1 and L-2. These are to have some predetermined angular relationship to the body seam S, the exact relationship depending upon the type of toe seams to be formed. Consistent attainment of the required angular relationship during production depends on the hose P being mounted on the supports 16 with its seam S correctly oriented. The transfer mechanism M is constructed and operative to effect a proper rotation of the pantihose P to obtain the correct orientation.

The transfer mechanism M and its operation will now be described with reference to FIGS. 1 and 2.

In the present embodiment, the transfer mechanism M comprises conveying means constituted by two coacting conveyors 30, 31. The two conveyors extend, between the line closer L and toe closer T, parallel to one another. The conveyors are not in-line, however. A downstream end of conveyor 30, which takes hose from the line closer L, overlaps an upstream end of conveyor 31 which delivers hose to the toe closer T. In the overlapping region, conveyor 30 is positioned above and to the side of conveyor 31. Where the conveyors overlap, hose are taken onto conveyor 31 from conveyor 30, and conveyor 31 ultimately deposits the hose onto toe closer supports 16 at the loading station 15.

Both conveyors 30, 31 have frames 32, 33 mounting respective pairs of endless conveying chains 34, 36 stretched between driven and idler sprocket means 37, 38. Drive means for the conveying chains 34, 36 are omitted from the drawings for simplicity of illustration. Any conventional drive means can be used. The directions of movement of the respective pairs of chains 34, 36 are shown by arrows in FIG. 1. The said pairs of chains have conveying flights which move from right to left, towards the toe closer T. The conveying flight of conveyor 30 is in a horizontal plane, and is located above the plane of the arms 10-1, 10-2 at the discharge station of the line closer L. The lower portions or runs of the chains 34 constitute the conveying flight of conveyor 30. The conveying flight of conveyor 31 is in a plane parallel to the common plane in whic the toe closer supports 16 lie at the loading station 15. This conveying flight passes close to, but appropriately spaced from, the supports 16. The conveying flight of conveyor 31 is constituted by the runs of the chains 36 which face the supports 16 at the loading station 15.

Both conveyors 30, 31 include a hose holder 39, 40, and preferably each includes two or more holders spaced apart along the length thereof. The holders 39, 40 each feature a set of four fingers 44 supported on a base 41, 42 which is fastened across, and immovably to, both chains 34, 36 of the respective conveyors 30, 31. The fingers 44 all have free ends which point forwards in the hoseconveying direction as they travel along the conveying flights of their respective conveyors. See holder 39 in FIG. 1, which is just commencing its travel in the conveying direction towards the toe closer T.

The four fingers 44 of each of the holders 39, 40 are mounted on the holder bases 41, 42 so as to be capable of executing certain movements with respect to one another and their associated bases. The various ways in which the fingers 44 move in the course of a transfer cycle will be described. The following description will indicate only in general terms how the fingers might be mounted to execute these movements. Similarly, means to cause the fingers to move at appropriate moments will be disclosed in general terms only. A detailed description of the fingers mounting and control means for the finger movements will not be given to avoid undue complication. Besides, actual designs and constructions will be well within the capabilities of ordinarily competent designers to devise.

FIGS. 2-1 to 2-3 illustrate the operation of the holder 39 seen from the direction of arrow A when about to pick up a pantihose P from the line closer L. In FIG. 2-1, the holder has just moved around sprocket means 38 and is commencing to travel along the conveying flight of conveyor 30. At this time, the arms 10-1, 10-2 of the line closer hose support are in their spread-apart condition holding a line-closed pantihose. The hose support is approaching the hose-discharge position. In FIG. 2-2, the arms 10-1, 10-2 are closing together as the holder approaches its discharge position. In FIG. 2-3 they are in their parallel positions in readiness for hose discharge. As the arms 10-1 and 10-2 are closing, the conveyor holder 39 is moving into the open welt (or waistband) of the hose P. The opening at the waistband is rather restricted, and so the arms 44 of the holder 39 have up to now been held in a closed setting in which they are close enough together easily to enter the open waistband. The fingers 44 may be mounted on telescopic or pivoted struts 45 (see FIG. 2-5) which are biased, e.g. by toggles or springs, to hold the fingers 44 in the closed setting. The struts 45 carrying the fingers 44 are carried by a mounting 46 supported by the base 41 of the holder. The mounting 46 can be moved closer or further from the base 41.

FIGS. 2-4 and 2-5, which illustrate the holder 39 and arms 10-1, 10-2 from the direction of arrow B, show the holder 39 in the course of taking over the body of the pantihose from the line closer holder 10. In FIG. 2-4, the holder 39 is moving forwards (i.e. towards the toe closer) with its closed fingers 44 located between the arms 10-1 and 10-2. In the course of its movement, a follower on the holder encounters a cam associated with the conveyor 30. The mounting 46 is cammed towards the base 46 temporarily. This lifts the fingers 44 of the advancing holder 39. The fingers are thus able to clear flexible bridging pieces (not shown) which are joined to the ends of the arms 10-1 and 10-1 that point towards the toe closer T. By the time the holder 39 has passed the said ends of arms 10-1 and 10-2 it has stripped the pantihose P from the line closer holder 10, and is now the only means holding the pantihose body. At a convenient time, the fingers 44 are caused to expand to their open positions. The body of the pantihose P and the waistband are then in a stretched condition encircling the four fingers 44, and are so prevented from slipping from the holder 39. See FIG. 2-5. Expansion of the fingers 44 is by appropriate activation of the struts 45, for instance by camming means associated with the conveyor 30 and a follower associated with the strut assembly. The fingers 44 remain open for so long as the hose P is being conveyed by the conveyor 30.

The mounting 46 is also supported to rotate about an axis shown at 48. At some convenient time after the fingers 44 have opened, the mounting is rotated—to rotate the fingers 44 jointly—in a given direction and through a predetermined angle. The angle is that necessary to change the pantihose orientation from that existing at the line closer to that needed for proper mounting on the toe closer. As exemplified above, the angle may be 54°. Rotation of the mounting 46 is achieved by camming means associated with the conveyor 30. The rotated condition is retained for so long as the holder 39 carries the hose P, i.e. until the hose is stripped from holder 39 by holder 40.

The hose P is thus conveyed in its stretched and rotated condition on holder 39 to the conveyor overlap region. In this region, transfer to holder 40 occurs. Once relieved of its hose, holder 39 continues moving and returns to the line closer L to pick up a fresh pantihose and convey it to the overlap region as described above.

As the holder 39 moves towards and into the overlap region, a holder 40 of conveyor 31 passes around sprocket means 37 ready to commence taking over the hose P. With the holder 39 in the overlap region, conveyor 30 is temporarily halted, while conveyor 31 continues moving. The moving holder 40 approaches holder 39 from behind (considered in relation to the conveying direction). The four, forwardly-pointing fingers 50 of the holder 40 are positioned such that they can enter the mouth of the waistband of hose P held on the fingers 44 of holder 39. As FIG. 2-6 shows, in both sets of fingers 44, 50, the fingers are at the corners of two similarly-oriented rectangles. The mutual spacing of fingers 50 is such that they clear fingers 44 as holder 40 moves into juxtaposition with stationary holder 39. As the fingers 50 enter hose P, camming means or other control means could at this time deactivate the struts 45 to withdraw the fingers 44 to their closed setting, thus leaving the hose on the fingers 50. Alternatively, the fingers 50 could be moved apart suitably to take over hold on the hose from fingers 44. Most simply, however, the two sets of fingers 44, 50 merely retain their positions as indicated in FIG. 2-6. Transfer to holder 40 occurs as the latter moves past the stationary holder 39 with brackets 52 each holding two fingers 50 pushing the hose of the fingers 44. When holder 40 has cleared holder 39, conveyor 30 can begin moving again to return holder 39 to the line closer L.

The lateral spacing between the two transversely opposed pair of fingers 50 is enough to stretch the hose body sufficiently to retain it on the fingers 50. The spacing is too small, however, to enable the fingers to load the hose body on the more widely separated toe closer supports 16. Means is therefore provided to move the said two pairs of fingers further apart as the holder 40 approaches the supports 16. To this end, the brackets 52 can be mounted on push-rods 54 operable to expand the lateral spacing. Appropriate movements of the push-rods 54 can be obtained through camming means associated with the conveyor 31. FIG. 2-7 shows the said pairs of fingers 50 moved apart and about to load the laterally-stretched hose body on the two holders 16.

When loading the holders 16, the conveyor holder 40 travels a pre-set distance along the holders 16. As it does this, the hose body is simultaneously mounted and everted on the holders 16. When the holder 40 has run its pre-set distance, the waistband of the hose P will be in the vicinity of the turret end of the supports 16. Eversion of the body may not be complete up to the waistband at this time, and so the waistband and adjacent knit may be doubled-back over a part of the body which has been everted. The fingers 50 of holder 40 are then activated to slip out from engagement with the hose P. This can be accomplished by mounting the brackets 52 to swing about an axis 56 longitudinally of the push-rods 54. The swing necessary to free the fingers from the uneverted waistband area is such that the brackets 52 flip over backwards, i.e. towards the line closer L. Camming means associated with the conveyor 31 may be used to swing the brackets 52 backwards, and spring means could be used to restore the brackets 52 to their normally erect state. Swinging means of the brackets 52 can take place while the holder 40 is moving and, unlike holder 39, there is no need for the holder 40 to pause periodically.

If the holders 16 are long enough, the pre-set distance travelled by holder 40 therealong could be great enough to evert the entire body of the pantihose P. Were this the case, there would be no need for the brackets 52 to flip over backwards. The fingers 40 would automatically disengage from the hose body upon eversion on the holders 16 being completed.

Modifications.

In the course of the foregoing description, several alternative constructional and operational features have been mentioned. Further modifications will now be described by way of example. The form which any particular apparatus will take will depend on the hosiery manufacturing machines being interconnected and on their individual forms.

Depending on the machines being interconnected the conveyors could be aligned; it may, however, be convenient for their conveying directions to be inclined and one, or both, of the conveyors could have a conveying path which is curved.

In some cases, it could be more convenient to relieve holder 39 of the ability to rotate its fingers 44. The holder 40 would then have this facility. Its fingers 50 would then be mounted to adopt the skewed attitude shown in FIG. 2-7 and another attitude matching that of the set of horizontally-arranged fingers 44 for taking over the hose therefrom.

The two conveyors 30, 31 could be replaced by a single conveyor in favourable circumstances. This can obviously avoid the need to transfer hose bodies from one holder to another. Each hose would remain on one holder during the entire transfer operation. The holder will be potentially more complex than either of holders 39 and 40 since it will have to perform most or all of their functions. The holder will need fingers able to open and close, to rotate as a unit and possibly to be carried on means enabling them to withdraw from the hose after depositing it on the supports 16. The fingers might have to be mounted for rather long excursions normal to its base if the single conveyor has its opposite ends spaced differently from the two respective supports 10, 16 of the line and toe closer L, T. When the fingers open, they could do so directly to the spacing allowing them to deposit the hose on the adjacent supports 16. This may be feasible if there is no obstruction to the movement of holder with its fingers so widely spread.

Where a single conveyor is employed, and it has a long enough run between the closers L and T, it might be possible to omit means enabling the fingers to rotate as a unit. The conveyor chains would be trained around two sprocket arrangements which are angularly related to one another in a manner similar to the angular relationship of the arms 10-1, 10-2, at the line closer discharge station, to the supports 16 at the toe closer loading station 15. In such an arrangement, the chains would twist and might need guiding. Flexible wire ropes of flexible belts might be substituted for chains.

In the foregoing description, a change in the angular orientation of the hose P is brought about by the manipulation of the hose holders 39, 40 or by a twisted-conveyor system. The angular orientation of the hose, can be further controlled by a motor-driven roller 60, FIG. 5. This is brought to bear against one or two of the fingers of e.g. holder 39 so as to rotate the body around the set of fingers. Suppose, for sake of argument, design constraints demand that the conveying flights of conveyors 30, 31 are at 54° to one another, but that the angular disparity between the planes of the seam S on the two machines L, T must be 18°. The fingers 44 of holder 39 may then rotate the body anti-clockwise 54° (looking in the direction of arrow B, FIG. 1). A motor driven roller will compensate by rotating the body 36° in the opposite direction to yield an overall 18° change in orientation of the seam. Of course, if the seam has to be turned through 90° in the transfer process, the motor driven roller will turn the body anticlockwise around the fingers 44.

Where the equipment comprises a Takatori Line Closer as described and a Speedomatic HS toe closer, a motor driven roller is not absolutely necessary. In the Speedomatic HS, the two adjacent supports lie in a common plane inclined at 36° to the horizontal. If the hose holder 39 were tilted i.e. rotated 54° anticlockwise (as seen looking from the line closer to the toe closer), the hose legs would be positioned correctly to line up with the toe closer supports 16 and the body seam would be properly oriented as indicated in FIG. 4A.

In fact, however, we currently prefer that the above equipment features a motor driven roller as part of the hose rotation means. Our equipment functions such that the hose holder 39 rotates 36° clockwise (viewed as specified in the last paragraph). This positions the fingers of holder 39 correctly for the fingers of holder 40 subsequently to take over the hose. The motor driven roller then rotates the hose 90° (in either direction). By this action, the roller orients the hose legs and body seam properly for later loading of the toe closer as shown in FIG. 4A.

Control of the operation of the motor driven roller, and thus control of the hose rotation on the hose support, can be afforded by means of a photo-electric device and a reference mark on the hose body. Such a general method of control is known in the toe closing art and is used, inter alia, in the Speedomatic HS machine.

The equipment disclosed herein only takes hold of and conveys the body ends of the hose P. Ancillary equipment, not forming part of this invention, may be provided to transport the hose toes in the suction tubes 17.

The embodiment described may be further modified as illustrated in FIG. 6 to ensure a secure transfer from the line closer support arms 10-1, 10-2 to the fingers 44 by providing on the upper finger mechanism a pad 61 movable by a cylinder 62 into and out of engagement with the upper fingers 44 so that the hose is secured between the pad and the upper fingers during transfer from the support arms 10-1, 10-2. In an alternative modification shown in FIG. 7, the four fingers 44 are replaced by two pairs 63 of broad fingers, each pair of fingers being movable together to grip the hose.

By a straightforward modification of the equipment, it could be made to operate in the opposite direction if it were desired to toe close before line closing. The transfer mechanism M would then strip hose from the toe closer T, convey it to the line closer L and load the hose on the latter.

The equipment has been described in connection with its primary application. It could be used, without substantial modification, for conveying single hose legs from one support to another when it is desired to rotate the legs in the course of conveying them.

We claim:

1. Hosiery manufacturing equipment including first and second spaced apart hose support means aligned with respect to each other, and a transfer means which strips hose from said first support means, carries same to said second support means and loads said hose thereon, said transfer means including endless conveyor means located between said first and second hose support means, said endless conveyor means having at least one hose holding means secured thereto and being movable therewith, said hose holding means including a set of hose gripping fingers, a portion of said conveyor means being positioned adjacent said first support means so that said fingers make engagement with the welt end of hose supported thereat and strip said hose from said support, after which said transfer means deliver said hose to said second support means and places said welt end of said hose in an encircling relationship on said second support means in a predetermined attitude with respect thereto.

2. Equipment according to claim 1, wherein the rotation effecting means is associated with the transfer mechanism and is operative to affect the hose rotation in the course of travel of the hose to the said other support.

3. Equipment according to claim 2, wherein the two supports are mutually inclined and the hose rotation means effects a rotation of the hose which is related to the angular relationship between the supports.

4. Equipment according to claim 3, wherein the hose rotation means is a longitudinal twist in the conveying means which has its opposite ends each parallel to the respective adjacent support, the twist causing the hose holding means to rotate as it moves between the supports.

5. Equipment according to claim 3, wherein the set of fingers is the hose rotating means and is carried by a pivotal mounting to rotate as a unit about an axis parallel to the fingers, there being means to rotate the finger unit in the course of the movement of the hose holding means between the apparatus.

6. Equipment as defined in claim 1, including securing means mounted on the holding means and movable against fingers of said set of fingers to secure a hose thereon.

7. Equipment as claimed in claim 6, in which the securing means comprises a pad.

8. Equipment as claimed in claim 6, in which the securing means comprises fingers cooperating with respective ones of said set of fingers.

9. Equipment according to claim 1, wherein the hose rotation means is a motor-driven roller which the holding means fingers contact in the course of the movement between the supports, the roller in use being controlled to turn the hose about the set of fingers through a predetermined rotational angle.

10. Equipment according to claim 9, wherein the fingers of the hose holding means are mounted to move apart after stripping hose from the said one support so as to stretch the hose welt end, thereby ensuring that the hose does not slip inadvertently from or around the fingers.

11. Equipment according to claim 1, wherein the conveying means comprise two elongated conveyors each having respective hose holding means with sets of forwardly-directed fingers, the conveyors being mounted so the downstream end of the first conveyor, which takes hose from the said one support, overlaps the adjacent upstream end of the second conveyor, the respective hose holding means being arranged to move into juxtaposition in the region where the conveyors overlap for the hose holding means of the second conveyor to strip the hose from the hose holding means of the first conveyor.

12. Equipment according to claim 11, wherein the fingers of the hose holding means of the second conveyor are so spaced apart as to enter the hose welt end held open by the fingers of the other hose holding means when the hose holding means are in juxtaposition.

13. Equipment according to claim 12, wherein the first conveyor is intermittently driven such that its holding means pauses in the overlap region for the moving holding means of the second conveyor to strip the hose from the stationary holding means.

14. Equipment according to claim 11, wherein the two supports are mutually inclined and the hose rotation means effect a rotation of the hose which is related to the angular relationship between the supports.

15. Equipment according to claim 14, wherein the hose rotating means comprise the set of fingers of at least one of the coacting hose holding means, the said set being carried on a pivotal mounting to rotate as a unit about an axis parallel to the fingers, and there being means to rotate the finger unit in the course of movement of the associated hose holding means.

16. Equipment according to claim 15, wherein the said one support is horizontially disposed and the other support is inclined to the horizontal, the set of fingers of the holding means of the second conveyor have an inclined attitude matching the inclination of the said other support, and the set of fingers of the holding means of the first conveyor are rotatable from a horizontal attitude to the said inclined attitude of the other holding means.

17. Equipment according to claim 11, wherein the hose rotation means further includes a motor-driven roller contactable with fingers of one of the hose holding means in the course of its hose-conveying movement, the roller in use being controlled to turn the hose about the set of fingers of the said holding means through a predetermined rotational angle.

18. Equipment according to claim 17, wherein the fingers of the hose holding means of each conveyor are mounted to move apart after taking hold of the hose to stretch its welt end and ensure the hose does not slip inadvertently from or around the fingers.

19. Equipment according to claim 18, wherein the fingers of the second conveyor holding means are mounted and arranged to withdraw in the direction of first conveyor from the hose welt end after placing the hose on the said other support.

20. Equipment according to claim 19, wherein the said fingers are mounted on pivoted brackets which are movable from a normal, erect setting to extract the fingers from the hose welt end.

21. Equipment according to claim 16, wherein the said one support is part of a hosiery line closer and the said other support is part of a hosiery toe closer.

22. Equipment according to claim 21, wherein each support comprises two associated limbs, the limbs of the line closer support being disposed in a common horizontal plane when hose is stripped therefrom by the transfer mechanism, and the limbs of the toe closer support being in a common plane inclined to the horizontal by an angle to which the predetemined rotation of the hose is related when hose is placed thereon by the transfer mechanism.

23. Hosiery manufacturing equipment as defined in claim 1 wherein said hose are pantihose and wherein said first hose support means forms a part of a line closer and said second hose support means forms a part of a toe closer.

24. Hosiery manufacturing equipment including first and second spaced apart hose support means and a transfer means which strips hose from said first support means carries it to said second support means and loads it thereon, said transfer means including endless conveyor means located between said first and second hose support means, and at least one hose support means associated therewith and being movable operationally between said support means, said hose holding means including a set of hose engaging finger means, a portion of said conveying means being positioned adjacent said first support means for said hose holding means to engage with the welt end of hose supported thereat, said transfer means being operative during transfer to effect removal of said hose from said first support means, carriage of said welt end of said hose to said second support means and placement of said welt end in an encircling relationship on said second support means, the equipment being adapted to place the hose on said second support means at a predetermined rotational attitude.

25. Manufacturing equipment for pantihose including a line closer having first support means for support of pantihose thereon, a toe closer for pantihose spaced apart from said line closer and having second support means for pantihose thereon, and a transfer mechanism which strips pantihose from said first support means, carries said pantihose to said second support means and loads same thereon, said transfer mechanism comprising first and second endless conveyors located between said line closer and said toe closer, said first conveyor being located adjacent said line closer and having pantihose holding means secured thereto and movable therewith into engagement with the waist portion of a pantihose on said first support means to remove said pantihose from said first support means and convey same to said second conveyor, said second conveyor being located between said first and second support means, and overlapping with said first conveyor, said second conveyor having pantihose holding means secured thereto and movable therewith into engagement with pantihose being held by said first conveyor pantihose holding means and conveying said pantihose to said second support means, said holding means on said second conveyor being operable to place the waist portion of said pantihose about said second support means.

26. A method for manufacturing pantihose from a pair of hose legs which are open at both ends, said pantihose having a body portion formed by seaming the legs together along a seam line which, in the finished pantihose, extends from the top of the body portion at the front through the crotch of the body portion and to the top of the body portion at the back, the method including the steps of:

mounting said hose legs on a holder therefor on a line closing machine;

advancing said mounted legs past a cutting and seaming station and joining said legs together by a seam to form said body portion, and thereafter advancing said pantihose to a discharge station;

transferring said hose from said discharge station of said line closer to a pair of suction tubes of a toe closing machine and mounting the hose thereon in a predetermined attitude, said transfer step including movement of an endless conveyor and hose engaging finger means associated therewith into engagement with said body portion and stripping said hose from said line closer, and thereafter transferring said pantihose to a pair of suction tubes of a toe closing machine, said transfer step further including sucking the hose legs free end first into respective ones of the suction tubes while disposing the body portion of said pantihose about said suction tubes in said attitude so that the sewn line of the body portion is located substantially centrally between the suction tubes and is in a plane substantially perpendicular to a plane containing the suction tubes;

everting the hose legs onto said suction tubes by moving the body portion rearwardly over the suction tubes to draw the legs out of and onto the tubes; and seaming the open free end of the legs to form closed toe ends.

* * * * *